United States Patent [19]

Shimizu et al.

[11] 4,299,559

[45] Nov. 10, 1981

[54] METHOD AND APPARATUS FOR MELTING GEL-LIKE SUBSTANCES

[75] Inventors: Masayuki Shimizu, Shizuoka; Keiichi Suzuki, Odawara; Kazutoshi Inada, Minami-ashigara, all of Japan

[73] Assignee: Fuji Photo Film Co., Ltd., Minami-ashigara, Japan

[21] Appl. No.: 149,591

[22] Filed: May 13, 1980

[30] Foreign Application Priority Data

Jun. 1, 1979 [JP] Japan ..... 54-68378

[51] Int. Cl.[3] ..... F27B 14/00; F27B 3/00

[52] U.S. Cl. ..... 432/13; 432/156; 432/228

[58] Field of Search ..... 432/13, 156, 195, 210, 432/211, 219, 228; 126/343.5 R, 343.5 A

[56] References Cited

U.S. PATENT DOCUMENTS

| | | | |
|---|---|---|---|
| 2,300,083 | 10/1942 | Worthington | 432/13 |
| 2,371,916 | 3/1945 | Rodenacker | 432/228 |
| 2,801,096 | 7/1957 | Selder | 432/228 |

*Primary Examiner*—John J. Camby

*Attorney, Agent, or Firm*—Sughrue, Mion, Zinn, Macpeak & Seas

[57] ABSTRACT

A method and apparatus for converting gel-like substances from a gel state to a sol state in which the melting speed can be accurately controlled over a wide range and the apparatus can be easily cleaned. A grid-type heater constructed of rotatable parallel heating pipes is disposed at the bottom of a melting tank. Rotation of the pipes which simultaneously heating them imparts flowability to a heat transfer boundary formed on the side of the gel-like substance. The melting speed is controlled by controlling the speed of rotation of the pipes.

5 Claims, 4 Drawing Figures

METHOD AND APPARATUS FOR MELTING GEL-LIKE SUBSTANCES

BACKGROUND OF THE INVENTION

The present invention relates to a method and apparatus for converting a substance which exhibits a sol-gel change from a gel state to a sol state depending upon temperature such as an emulsion or an emulsified product used in manufacturing photographic material.

During the manufacture of photographic material it is necessary to cool gel-like substances such as photographic emulsions, matting agents or emulsified products after preparation, store them at low temperatures, and melt them as required when they are to be coated on a support. Two primary methods for melting such gel-like substances have been used in the past. One of these is a so-called batchwise method such as disclosed in Japanese Patent Publication Nos. 9495/69 and 1738/76 while the other is a melting method based on continuous control as disclosed in Japanese Laid-Open Patent Publication No. 34713/76 and U.S. Pat. No. 3,847,616.

The batchwise method is disadvantageous in that the gel-like substance tends to undergo localized overheating within a container, a long period of time is required for it to be completely melted, and the amount of the final product is small. Hence, this method is not feasible for use with gel-like substances such as photographic emulsions which undergo qualitative degradation with the passage of time.

With the latter melting method, the gel-like substance is placed on a grid-type heater in the shape of, for example, convolutions provided at the bottom portion of a melting tank, a heating medium is introduced into the grid, and the gel-like substance is continuously melted. Since this method permits the melting operation to be carried out continuously, the gel-like substance can be treated in the same vessel within a shorter period of time than with the batchwise method.

The melting method, however, has the following disadvantages.

(i) The melting speed must be adjusted by varying the flow rate, temperature or pressure of the heating medium introduced into the grid. Hence the melting speed cannot be markedly increased because there are limits to the permissible ranges of these parameters. For example, if the temperature is raised to too high a level, the properties of the gel-like substance are adversely affected. The melt-treating time is therefore difficult to shorten.

(ii) For the same reasons, the margin of control of the melting speed is narrow, and its control is difficult.

(iii) Since the heater is fixed to the bottom of the tank, it is troublesome to wash the tank, especially the undersurface of the heater, and a long period of time is required for a complete washing of the tank.

Accordingly, it is an object of the invention to provide a method for melting a gel-like substance which eliminates the aforesaid disadvantages of conventional melting methods and in which the speed of melting the gel-like substance is greatly increased, the margin of control of the melting speed is increased, and the melting tank can be easily washed.

Another object of the invention is to provide an apparatus for practicing the aforesaid method.

SUMMARY OF THE INVENTION

The inventors have investigated the cause of the aforesaid disadvantages, especially (i) and (ii), and have as a result ascertained that there is a marked difference in the thickness of a heat transfer boundary film at the tube wall between a heat transfer medium flowing through a tube of a grid-type heater and a gel-like substance and that the ratio of the heat transfer coefficient of the heat transfer boundary film on the side of the heat transfer medium (warm water) to that on the side of the gel-like substance (photographic emulsion) may range from about 10 to about 20. It has been found, in view of this situation, that an increase of the melting speed of the gel-like substance can be achieved by minimizing the thickness of the heat transfer boundary film on the side of the gel-like substance. This discovery has led to the present invention.

Accordingly, the aforesaid objects of the invention are achieved by a method for melting a gel-like substance which includes feeding the gel-like substances to a heating surface provided at the bottom of the inside of a melting tank, heating the gel-like substance at the heating surface to convert it to a sol, and withdrawing the sol from the bottom of the melting tank wherein, during the melting of the gel-like substance, the heating surface is rotated to impart flowability to the heat transfer boundary film on the side of the gel-like substance. The invention also encompasses an apparatus for practicing this method.

BRIEF DESCRIPTION OF THE DRAWINGS

The present invention is described in detail below with reference to preferred embodiments thereof illustrated in the accompanying drawings in which:

FIG. 3 is a side sectional view of heating pipes used with; and

DESCRIPTION OF THE PREFERRED EMBODIMENTS

Figure 1:
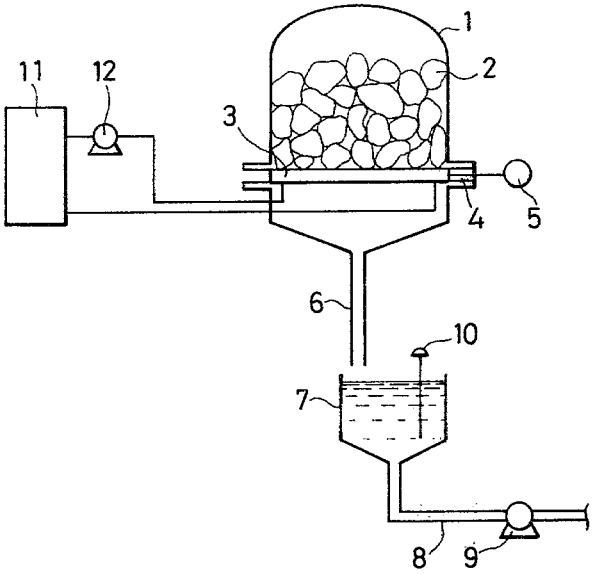
FIG. 1 is a side elevation showing an apparatus according to a preferred embodiment of the invention.

Referring to FIG. 1 which shows the overall structure of an apparatus for melting a photographic emulsion as a gel-like substance constructed according to a preferred embodiment of the invention, reference numeral 1 designates a melting tank with a closed interior, 2 the photographic emulsion to be melted, 3 heating pipes, 4 a coupling, 5 a motor, 6 a tubular line through which the photographic emulsion converted to sol by melting is withdrawn, 7 a stock tank, 8 a conduit for drawing off the photographic emulsion, 9 a liquid feed pump, 10 a thermometer, 11 a constant temperature bath using a stock of warm water as a heating medium, and 12 a liquid feed pump for circulating warm water.

As shown, in the apparatus of the invention, a predetermined amount of crushed gel-like photographic emulsion is fed into the tank 1 upon the surface of the heating pipes 3 provided at the lower portion of the tank 1. Warm water is passed through the heating pipes 3 from the constant temperature bath 11 by means of pump 12 thereby beating the pipes. Simultaneously, the motor 5 rotates the pipes 3 about their center. The photographic emulsion converted to a sol by melting is taken out through the tubular line 6 and temporarily stored in the tank 7. After its flow rate has been adjusted to a constant value, the photographic emulsion is transferred to a coating station through the line 8 by the pump 9.

Figure 2:
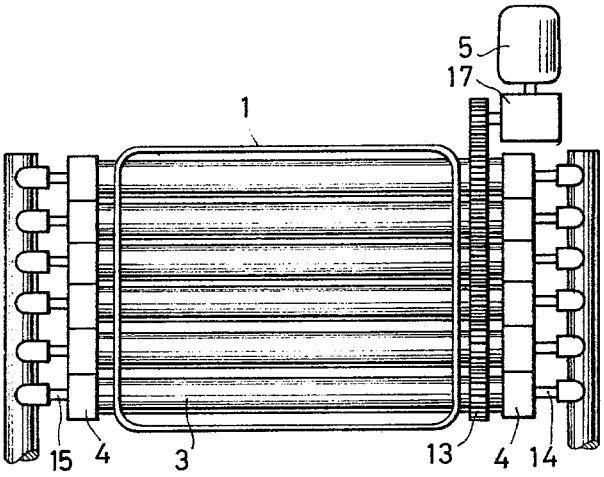
FIG. 2 is a top plane view of the principal parts of the apparatus shown in FIG. 1.
Figure 3:
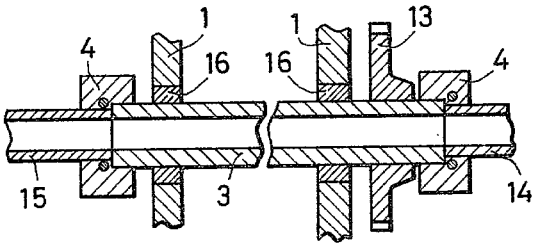

As shown in FIG. 2, the heating pipes 3 are aligned parallel to each other with small gaps therebetween. To one end of each of these pipes are fixed a gear 13, a coupling 4 and a liquid feed pipe 14 leading to the constant temperature bath 11 while a coupling 4 and a liquid discharge pipe 15 which leads to the constant temperature bath 11 are fixed to the other end. At that part of each heating pipe 3 where it passes through the tank 1, a sealing bearing 16 such as a bearing fashioned of hard Teflon (registered Trademark) is fitted as shown in FIG. 3. The inside of the tank 1 is completely closed. The individual heating pipes 3 are mechanically rotatingly connected to each other the gears 13. The gears 13 are connected to the motor 5 via a reduction gear 17. When the motor 5 rotates, the heating pipes 3 are simultaneously rotated, for instance at speeds of up to 50 rpm.

Hot water at 50° to 60° C. is introduced into the heating pipes 3 and heat from the warm water is transferred to the gel-like substance 2 through the walls of the heating pipes 3. Desirably, the heating pipes 3 are made of a thin metallic pipe having a high thermal conductivity. The diameter, length, and other properties of the heating pipes are properly determined depending upon the amount of gel-like substance to be treated.

A characteristic feature of the invention is that, in melting the photographic emulsion 2, the heating pipes 3 whose walls have been heated with warm water are rotated about their centers. This feature brings provides for the following operation and brings about the following noted results.

(i) When the heating pipes 3 are rotated, the photographic emulsion 2 in contact with the heating pipes 3 is rendered flowable and the thickness of the heat transfer boundary film on the side of the photographic emulsion is reduced. Accordingly, the coefficient of heat transfer increases and the attainable speed of melting the photographic emulsion 2 is markedly increased.

Figure 4:
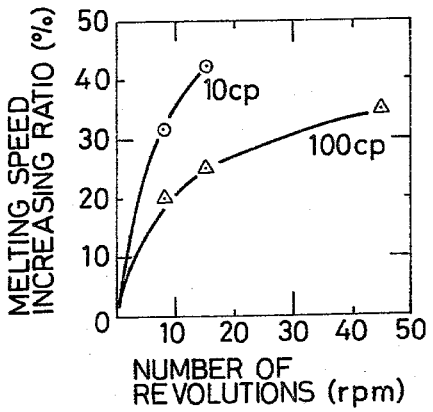
FIG. 4 is a melting speed characteristic diagram obtained by rotating a heating surface.

(ii) The increase in the speed of melting the photographic emulsion 2 increases as the speed of rotation of the heating pipes is increased, as shown in FIG. 4. This becomes more pronounced as the viscosity of the melted photographic emulsions is lowered. Thus, the speed of melting the photographic emulsion 2 can be controlled by controlling the speed of rotation of the heating pipes 3. As a result, the margin of control of the melting speed is broadened compared with a conventional method which depends only upon the parameters noted above for controlling the heating medium.

(iii) When the inside of the melting tank 1 is washed during maintenance of the apparatus, the entire heating surface can be washed by simply feeding wash water from the side of the tank 1 while the heating pipes 3 are rotated. The efficiency of the cleaning operation is therefore greatly increased.

While the present invention has been described hereinabove with reference to a preferred embodiment in which a photographic emulsion is melted, it should be understood that the invention is not limited to the aforesaid embodiment and that various changes and modifications are possible within the spirit and scope of the invention as described in the specification and in the appended claims.

For example, the gel-like substance to be melted is not limited to photographic emulsions and the invention is applicable to all gel-like substances which can be converted to a sol. The heating medium may also be steam under reduced pressure or another known medium. Moreover, the shape, number and the like of the heating pipes forming the heating surface may be changed as required.

As described in detail hereinabove, the present invention makes it possible to increase the speed of melting the gel-like substance and to control the melting speed by adjusting the speed of rotation of the heating surface. Moreover, the operation of washing the melting tank can be simplified and the washing time can be greatly reduced.

What is claimed is:

1. A method for melting a gel-like substance comprising the steps of feeding the gel-like substance to rest on top of a heating surface provided at the bottom of the inside of a melting tank, said heating surface having gaps heating said gel-like substance at the heating surface to convert it to a sol which then flows through said gaps to the bottom of the melting tank, and withdrawing the sol from the bottom of the melting tank, rotating said heating surface to provide flowability to a heat transfer boundary film on the side of the gel-like substance.

2. The method of claim 1 further comprising the step of controlling the speed of melting said gel-like substance by controlling the speed of rotation of said heating surface during the melting of said gel-like substance.

3. The method of claim 1 or 2 wherein said gel-like substance is a photographic emulsion.

4. An apparatus for melting a gel-like substance to a sol comprising: a grid-type heater comprising rotatable heating pipes aligned parallel to each other with small gaps therebetween, said heating pipes holding the gel-like substance on top prior to heating and allowing the sol to pass through said small gaps said heater being disposed at the lower portion of the inside of a melting tank, means for rotating said rotatable pipes at a predetermined speed of rotation, means for withdrawing said sol substance resulting from the melting said gel-like substance by said heater from the bottom of said melting tank.

5. The apparatus of claim 4 wherein said rotating means comprises a motor means and gear means rotationally compling each of said rotatable pipes to said motor means.

* * * * *